US006883366B1

(12) United States Patent
Gehman et al.

(10) Patent No.: US 6,883,366 B1
(45) Date of Patent: Apr. 26, 2005

(54) TAMPER RESISTANT VAPOR SENSOR METHOD AND SYSTEM

(75) Inventors: Richard W. Gehman, Freeport, IL (US); Todd H. Sellman, Lena, IL (US); Richard C. Cholke, Pecatonica, IL (US); Michael R. Hoefer, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/688,681

(22) Filed: Oct. 17, 2003

(51) Int. Cl.[7] ..... G01N 25/56
(52) U.S. Cl. ..... 73/25.04
(58) Field of Search ..... 73/25.04, 25.01, 73/25.05

(56) References Cited

U.S. PATENT DOCUMENTS

| | | | | |
|---|---|---|---|---|
| 6,198,295 | B1 | 3/2001 | Hill | 324/711 |
| 6,390,028 | B1 | 5/2002 | Langmead et al. | 122/14.2 |
| 6,412,447 | B1 | 7/2002 | Trant et al. | 122/14.21 |
| 6,540,504 | B2 | 4/2003 | Kobayashi et al. | 431/77 |
| 6,561,138 | B2 * | 5/2003 | Kobayashi et al. | 122/504 |
| 6,622,661 | B1 | 9/2003 | Hotton | 122/13.01 |
| 6,626,133 | B2 | 9/2003 | Schell et al. | 122/504 |
| 6,662,757 | B2 * | 12/2003 | Lesage | 122/14.21 |
| 6,722,876 | B2 * | 4/2004 | Abraham et al. | 431/22 |
| 2001/0038986 | A1 | 11/2001 | Abraham et al. | 431/22 |

* cited by examiner

*Primary Examiner*—Hezron Williams
*Assistant Examiner*—Rodney Frank
(74) *Attorney, Agent, or Firm*—Kris T. Fredrick; Kermit D. Lopez; Luis M. Ortiz

(57) ABSTRACT

A vapor sensor is disclosed, which includes a substrate containing a sensing element, wherein the substrate is located proximate to a sleeve portion which covers and protects the sensing element. The vapor sensor also includes a vapor filter or permeable membrane affixed to an end of the sleeve portion, wherein the end of the sleeve portion is located opposite the sensing element. A housing and a cover are also provided, such that the housing retains the substrate and the cover snaps onto the housing. The housing itself includes walls from which a hole is formed through which vapors may pass. The vapor sensor can be mounted to a gas water heater in such a manner as to reduce air flow to the sensing element and prevent tampering of the vapor sensor unit itself.

17 Claims, 5 Drawing Sheets

TAMPER RESISTANT VAPOR SENSOR METHOD AND SYSTEM

TECHNICAL FIELD

Embodiments are generally related to sensing methods and systems. Embodiments are also related to residential and consumer appliances in general and fuel-fired heating appliances, such as, for example, gas-powered water heaters. Embodiments are also related to vapor sensors for detecting gas vapors.

BACKGROUND OF THE INVENTION

Gas-fired residential and commercial water heaters are generally formed to include a vertical cylindrical water storage tank with a gas burner disposed in a combustion chamber below the tank. The burner is supplied with fuel gas through a valved gas supply line, and combustion air through an air inlet flow path providing communication between the exterior of the water heater and the interior of the combustion chamber.

Water heaters of this general type are extremely safe and quite reliable in operation. When gasoline or other flammable liquids are stored or used improperly in proximity to the water heater, however, it is possible that flammable vapors may become entrained in the air intake of the water heater. Such vapors might cause secondary combustion to occur within the confines of the water heater combustion chamber.

In residences where gas water heaters are located in close proximity to gasoline containers, there is a potential for the gasoline vapors to be ignited by an ignition device, such as, for example, the water heater pilot flame. A vapor sensor mounted to the water heater would shut down the pilot if gasoline vapors are detected. Present sensors capable of detecting flammable vapors can be rendered ineffective or deliver false alarms when the sensing element is damaged, exposed to air flow, dust, liquids, oils, or other contaminants. The sensor may also be rendered ineffective if deliberately blocked so that vapors cannot reach the sense elements.

In view of the foregoing, a continuing need exists for the preclusion of fuel flow to the appliance when extraneous flammable vapors are present exteriorly adjacent the appliance. In particular, a continuing need exists for improved gas vapor sensors, which are resistant to contamination and also tampering.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide an improved sensor apparatus and method.

It is another aspect of the present invention to provide for an improved gas vapor sensor.

It is a further aspect of the present invention to provide for an improved gas vapor sensor, which is resistant to tampering and contamination from materials such as, for example, air flow, dust, liquids, and oils.

The aforementioned aspects of the invention and other objectives and advantages can now be achieved as described herein. A vapor sensor is disclosed, which includes a substrate containing a sensing element, wherein the substrate is located proximate to a sleeve portion which covers and protects the sensing element. The vapor sensor also includes a vapor filter affixed to an end of the sleeve portion, wherein the end of the sleeve portion is located opposite the sensing element. A housing and a cover are also provided, such that the housing retains the substrate and the cover snaps onto the housing. The housing itself includes walls from which a hole is formed through which vapors may pass.

The housing and the cover protect the vapor sensor apparatus from gravitationally settled materials thereof. Contoured surfaces are generally formed from the housing and cover, which include one or more recessed areas that allow access to the hole by vapors. The hole is located centrally above sensing element. Additionally, the vapor filter can be formed of a fine mesh material. The sleeve portion also can be formed as a plastic sleeve attached to the substrate, while the cover and the housing can also be made from a plastic material. Plastic is, of course, an optional feature. Other types of materials may also be utilized in accordance with alternative embodiments.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate embodiments of the present invention and are not intended to limit the scope thereof.

Figure 1:
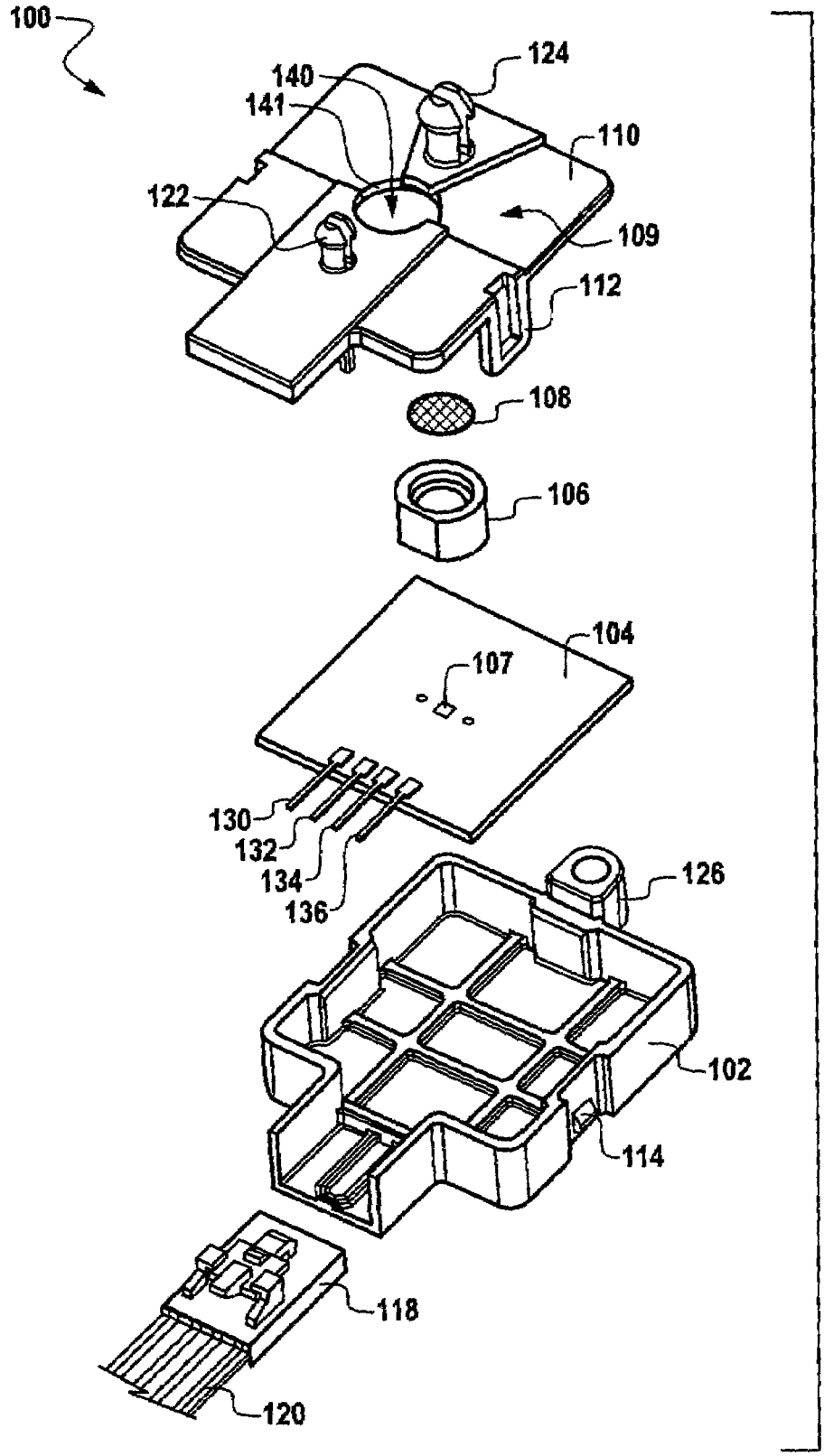
FIG. 1 illustrates an exploded view of a vapor sensor apparatus, which can be implemented in accordance with an embodiment of the present invention.
Figure 2:
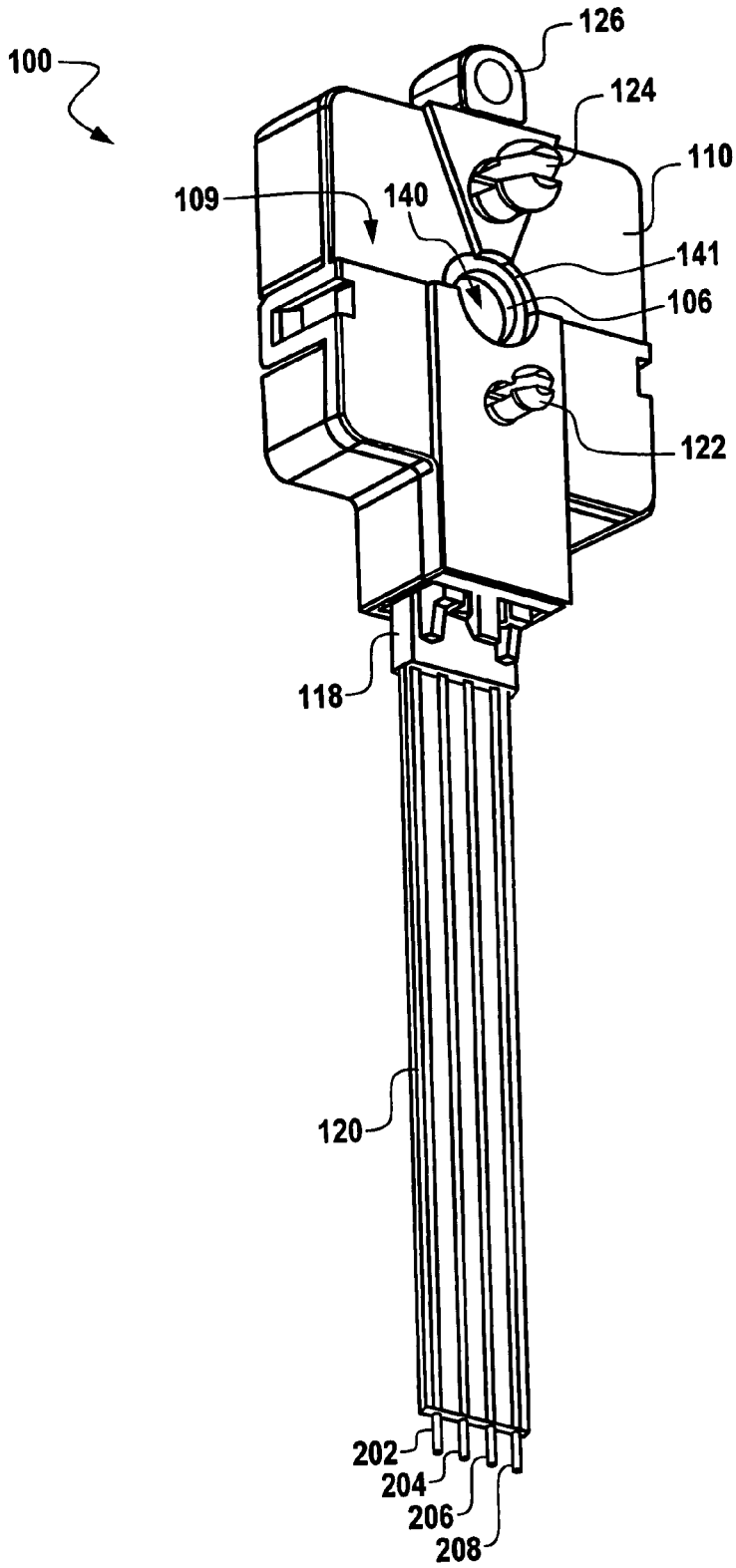
FIG. 2 illustrates a compacted view of the vapor sensor apparatus of FIG. 1, in accordance with an embodiment of the present invention.

FIG. 1 illustrates an exploded view of a vapor sensor apparatus 100, which can be implemented in accordance with an embodiment of the present invention. FIG. 2, on the other hand, illustrates a compacted view of the sensor apparatus of FIG. 1, in accordance with an embodiment of the present invention. Note that in FIGS. 1 and 2, similar or identical parts are generally indicated by identical reference numerals. Vapor sensor apparatus 100 generally includes at least two one-way snap posts 122 and 124, which can mount the sensor apparatus 100 to a wall of a water heater, thereby providing protection to the sensor surface from physical impact.

Vapor sensor apparatus 100 generally includes a contoured surface 109 of a cover 110 for a housing 102. The contoured surface 109 permits the vapor sensor apparatus to be mounted in close proximity to a water heater. Recessed areas on such a contoured surface allows access of vapors to a hole 140 that is formed from circular internal walls 141 of the cover 110. The hole 140 is located generally within the center of cover 110 directly over a sensing element 107, which is protected by a sleeve portion 106 for maintaining and protecting sensing element 107.

Although sensing element 107 is shown in FIG. 1 as having a square shape, it can be appreciated that the shape of sensing element 107 can also be circular or rectangular as can the shape of sleeve portion 106. The recesses (e.g., hole 150) can be sized so as not to allow foreign materials to enter the access hole 140. Hole 140, can for example, be angled downward so as to allow foreign particles and fluids to move away from hole 140 and prevent gravitation settling of dust or liquids.

Vapor sensor apparatus 100 can be designed to accept a connector with a latching feature as shown in 118 and its mating surface in the housing 102. The keying of the connector can result in the latching feature to also be within close proximity to a wall of the water heater, which may require a tool to disengage the connector. The sleeve portion 106 which surrounds and protects the sensing element 107 can comprise a filter, permeable membrane or fine mesh screen, which passes vapors, but protects the internal components of vapor sensor apparatus 100 from dust and liquids. Housing 114 generally includes a tabular or snap portion which can connect to a receiving portion 112 of cover 110. Vapor sensor apparatus 100 also includes leads 130, 132, 134, and 136, which are connected to substrate 104. Leads 130, 132, 134 and 136 respectively connect to leads 202, 204, 206, and 208 through a lead portion 120, a portion 118 of which is maintained by housing 102 and cover 110.

In general, a substrate 104 contains sensing element 107, which is protected by sleeve portion 106. Note that sleeve portion 106 can be configured as a plastic sleeve. Plastic is, of course, an optional feature. Other types of materials may also be utilized in accordance with alternative embodiments. The sleeve portion 106 or plastic sleeve is generally attached to substrate 104 to cover and protect sensing element 107. A filter 108 is generally affixed to the end of the sleeve portion 106 that is opposite substrate 104. Filter 108 can be formed from a fine mesh material that passes vapors (e.g., gas vapors), but does not allow foreign materials to enter and/or come into contact with sensing element 107.

A substrate assembly, which includes substrate 104 and leads 130, 132, 134, and 136 can be located and assembled within housing 102 to retain the substrate 104. Housing 102 can be formed from a plastic material, as can cover 110. Again, plastic is an optional feature. Other types of materials may also be utilized in accordance with alternative embodiments. The design of the cover 110 and housing 102 generally allows the connector 118 to be keyed for insertion and ensure that the vapor sensor apparatus 100 is protected from gravitationally settled dust or liquids. The vapor sensor apparatus 100 can then be mounted into a water heater and an electrical connection made.

Figure 3:
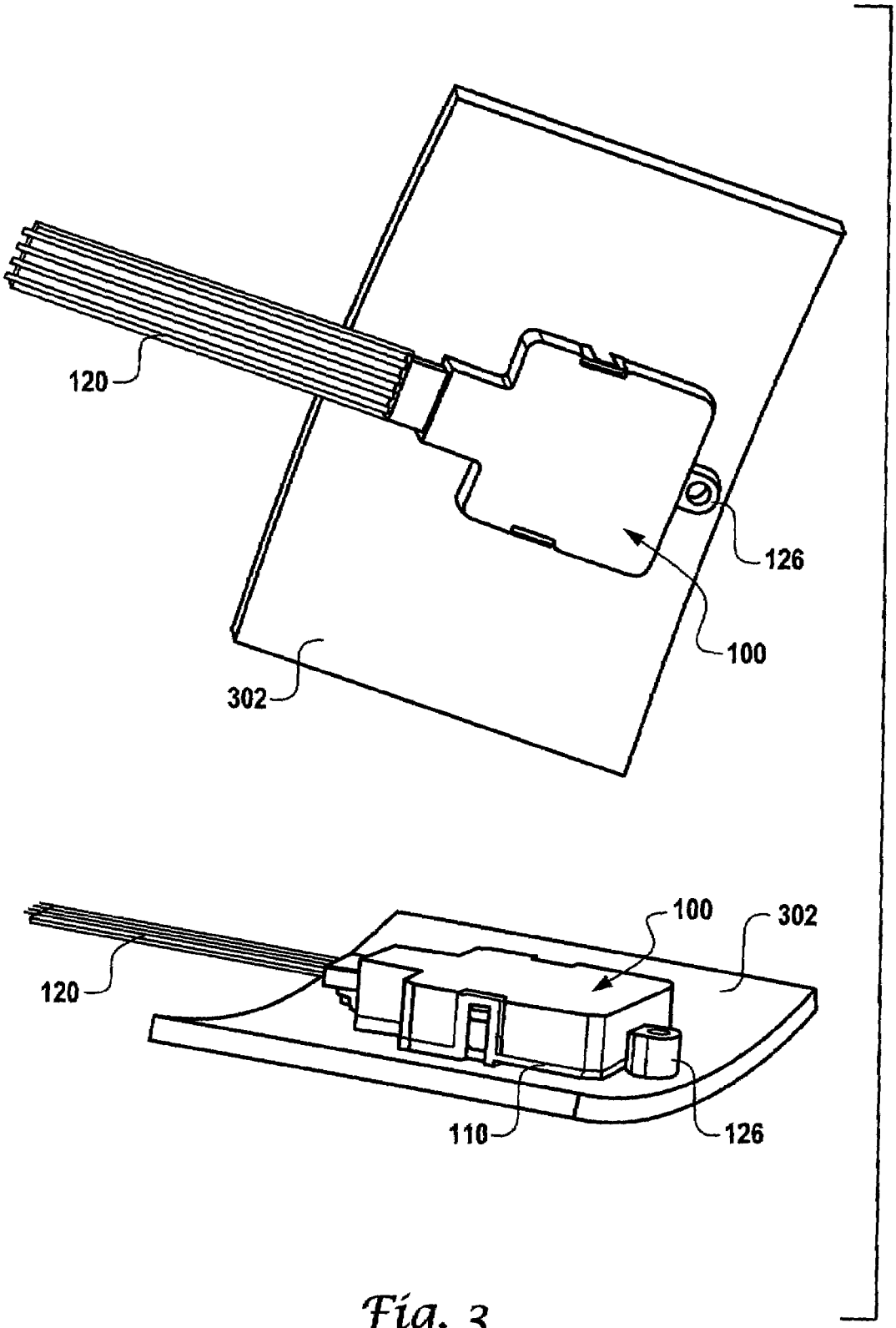
FIG. 3 illustrates perspective views of the vapor sensor apparatus depicted in FIGS. 1–2 engaged with the walls of a water heater, in accordance with an embodiment of the present invention.
Figure 4:
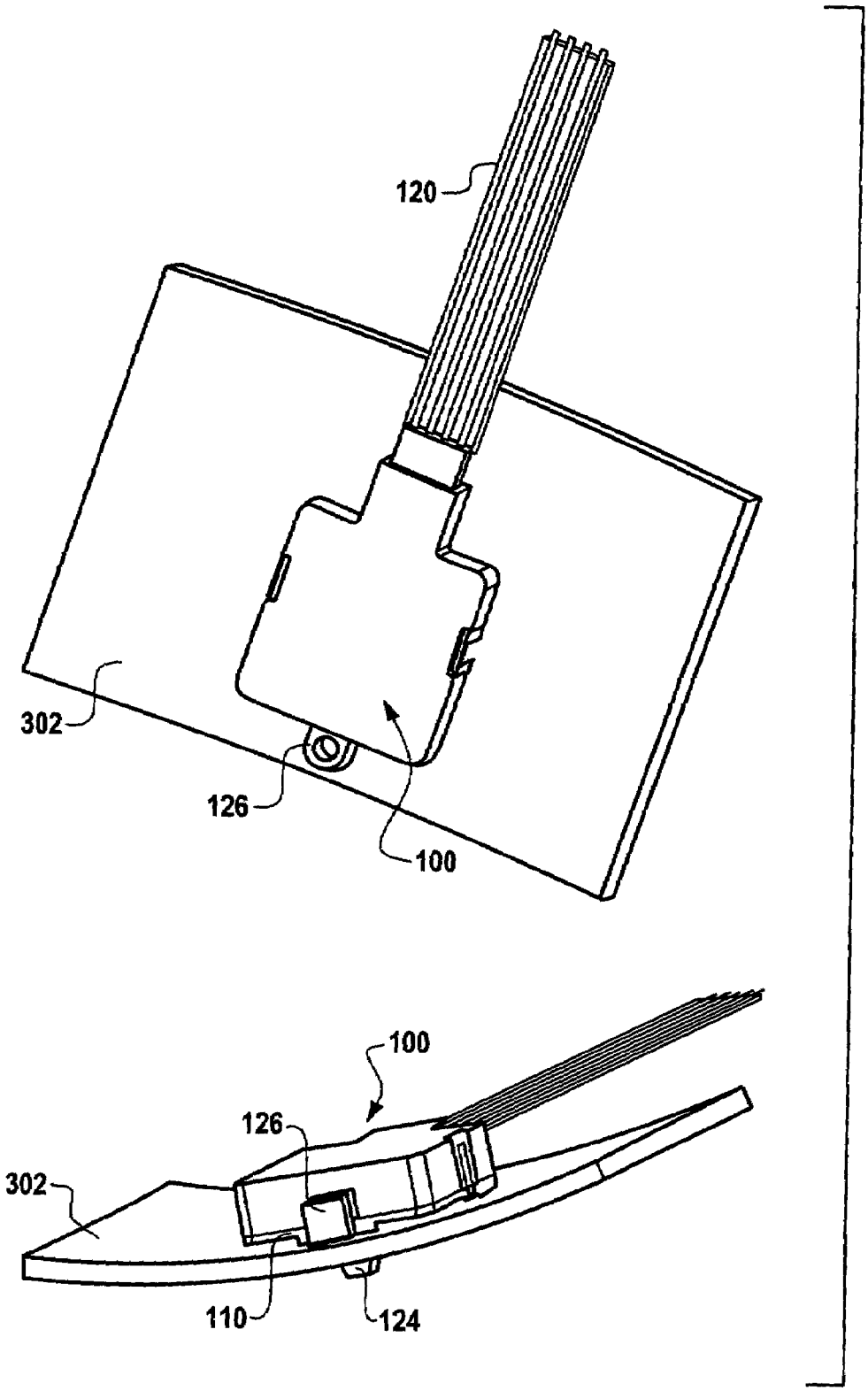
FIG. 4 illustrates alternative perspective views of the vapor sensor apparatus depicted in FIG. 1–3 engaged with the walls of a water heater, in accordance with an embodiment of the present invention.

FIG. 3 illustrates perspective views of the vapor sensor 100 apparatus depicted in FIGS. 1–2 engaged with a wall 302 of a water heater, in accordance with an embodiment of the present invention. FIG. 4 illustrates alternative perspective views of the vapor sensor apparatus 100 depicted in FIG. 1–3 engaged with wall 302. Note that in FIGS. 1–5, similar or identical parts are indicated by identical reference numerals. Thus, vapor sensor apparatus 100 is shown in both FIGS. 3 and 4 with the cover 110 in contact with wall 302 of the water heater.

Figure 5:
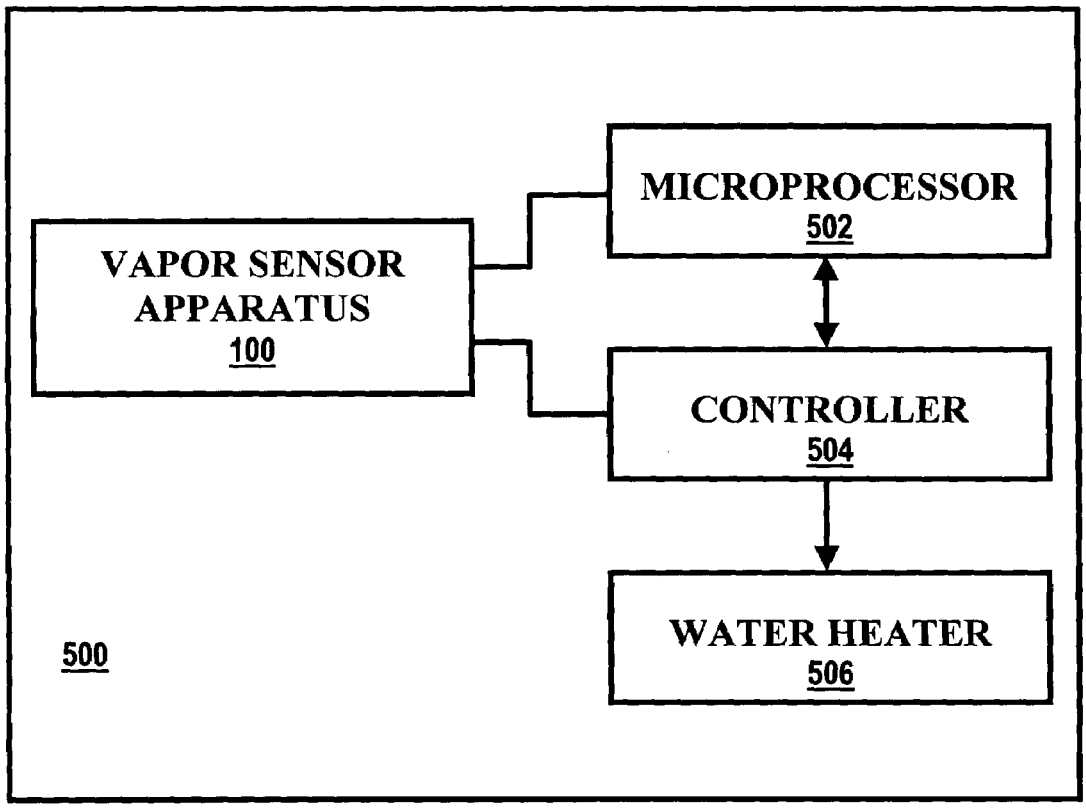
FIG. 5 illustrates a block diagram of a vapor sensing system, in accordance with an alternative embodiment of the present invention.

FIG. 5 illustrates a block diagram of a vapor sensing system 500, in accordance with an alternative embodiment of the present invention. Vapor sensor apparatus 100 can communicate with a microprocessor 502 and a controller 504 to form a vapor sensing system 500 that can be utilized to automatically shut off water heater 506 in the event that gas vapors are detected by vapor sensor apparatus 100. The vapor sensor apparatus (e.g., a gas vapor sensor) can be mounted to the water 506 as explained previously.

As indicated in FIGS. 3 and 4 above, the vapor sensor apparatus 100 is mounted to a water heater (e.g., wall 302 of a water heater 506) in a manner which reduces air flow to the sensing element 107 and which also prevents or limits tampering of vapor sensor apparatus 100, because the cover 110 of the vapor sensor apparatus 100 faces the wall 302 of water heater 506. Alternatively, the sensor may be mounted on the concave or convex surface of the casing (i.e., walls of the water heater 506). The apparatus described herein will also function properly if mounted on a flat surface. The vapor sensor apparatus 100 can thus automatically shut off, via microprocessor 502 and controller 504, a pilot flame (i.e. a "pilot") or other ignition device associated with the water heater 506 if gas vapors are detected.

Note that microprocessor 502 can be implemented as central processing unit (CPU) of a computer or other data-processing machines. Examples of microprocessor chips which can be utilized in accordance with embodiments include microprocessors such as the "Pentium" line of microprocessor from Intel Corporation, the PowerPC chip, and so forth. Of course, it can be appreciated that these chips are only presented for illustrative and exemplary purposes and do not represent limiting features of the present invention. Microprocessor 502 generally functions to process and manipulate data. For example, microprocessor 502 performs processing functions, which is generally a vital procedure between receiving data (i.e., input) and producing results (e.g., output). Controller 504, on the other hand, generally performs an arbitrating or regulating function and is utilized to control "on" and "off" functions associated with water heater 506.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The embodiments of the invention in which an exclusive property or right is claimed are defined as follows. Having thus described the invention what is claimed is:

1. A vapor sensor apparatus, comprising:

a substrate containing a sensing element, wherein said substrate is located proximate to a sleeve portion which covers and protects said sensing element;

a vapor filter affixed to an end of said sleeve portion, wherein said end of said sleeve portion is located opposite said sensing element; and a housing for retaining said substrate and a cover which snaps onto said housing, wherein said housing comprises walls from which a hole is formed through which vapors may pass, and wherein housing and said cover protect said vapor sensor apparatus from gravitationally settled materials thereof.

2. The apparatus of claim 1 wherein said vapor filter comprises a permeable membrane.

3. The apparatus of claim 1 comprising a plurality of contoured surfaces which form least one recessed area from plurality of contoured surfaces, such that said at least one recessed area allows access to vapors to said hole.

4. The apparatus of claim 1, wherein said hole is located centrally over above sensing element.

5. The apparatus of claim 1 wherein said vapor filter comprises a fine mesh material.

6. The apparatus of claim 1 wherein said sleeve portion comprises a plastic sleeve attached to said substrate.

7. The apparatus of claim 1 wherein said cover and said housing are formed from a plastic material.

8. A method for forming a vapor sensor apparatus, comprising the steps of:

providing a substrate containing a sensing element, wherein said substrate is located proximate to a sleeve portion which covers and protects said sensing element;

connecting a vapor filter to an end of said sleeve portion, wherein said end of said sleeve portion is located opposite said sensing element; and providing a housing for retaining said substrate and a cover which snaps onto said housing, wherein said housing comprises walls from which a hole is formed through which vapors may pass, and wherein housing and said cover protect said vapor sensor apparatus from gravitationally settled materials thereof.

9. The method of claim 8 further comprising the step of configuring a plurality of contoured surfaces on said vapor sensor apparatus, wherein said plurality of contoured surfaces form least one recessed area that allows access to vapors to said hole.

10. The method of claim 8 further comprising the step of locating said hole is located centrally over above sensing element.

11. The method of claim 8 further comprising the step of forming said vapor filter from a fine mesh material.

12. The method of claim 8 further comprising the step of configuring said sleeve portion to comprise a plastic sleeve attached to said substrate.

13. The method of claim 8 further comprising the step of forming said cover and said housing are from a plastic material.

14. A vapor sensor system, comprising:

a gas vapor sensor comprising a substrate that includes a sensing element, wherein said substrate is located proximate to a sleeve portion which covers and protects said sensing element, wherein said gas vapor sensor further comprises a gas vapor filter affixed to an end of said sleeve portion, wherein said end of said sleeve portion is located opposite said sensing element and wherein said gas vapor filter comprises a permeable membrane;

a water heater to which said gas vapor sensor is mounted, wherein said gas vapor sensor is mounted proximate to said water heater in a manner which reduces air flow to said sensing element and prevents tampering of said gas vapor sensor, such that said gas vapor sensor automatically shuts off an ignition device associated with said water heater if said gas vapor sensor detects gas vapors; and a controller and a microprocessor associated with said gas vapor sensor, wherein said controller and said microprocessor respectively control operations of said gas vapor sensor and processes vapor detection information.

15. The system of claim 14 further comprising a housing for retaining said substrate and a cover which snaps onto said housing, wherein said housing comprises walls from which a hole is formed through which vapors may pass, and wherein housing and said cover protect said gas vapor sensor from gravitationally settled materials thereof.

16. The system of claim 15 wherein said gas vapor sensor comprises a plurality of contoured surfaces which form at least one recessed area from plurality of contoured surfaces, such that said at least one recessed area allows access to vapors to said hole.

17. The system of claim 16 wherein said hole is located centrally over above sensing element.

* * * * *